US010316575B2

(12) United States Patent
Hoogland et al.

(10) Patent No.: US 10,316,575 B2
(45) Date of Patent: Jun. 11, 2019

(54) RESERVE CLADDING BIASING

(71) Applicant: Pella Corporation, Pella, IA (US)

(72) Inventors: Jonathan S. Hoogland, Pella, IA (US); Scot C. Miller, Pella, IA (US); Randy L. Black, Newton, IA (US); Jason L. Jungling, Altoona, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 15/843,520

(22) Filed: Dec. 15, 2017

(65) Prior Publication Data

US 2018/0171699 A1 Jun. 21, 2018

Related U.S. Application Data

(60) Provisional application No. 62/435,215, filed on Dec. 16, 2016.

(51) Int. Cl.
*E06B 3/30* (2006.01)

(52) U.S. Cl.
CPC ..... *E06B 3/302* (2013.01)

(58) Field of Classification Search
CPC ..... E06B 3/302
USPC ..... 52/204.53
See application file for complete search history.

(56) References Cited

U.S. PATENT DOCUMENTS 2,124,775 A * 7/1938 Haugaard ..... E06B 1/6084 52/211
2,837,784 A * 6/1958 Jannette ..... E06B 3/302 49/463
3,388,517 A * 6/1968 Wohl ..... E06B 3/62 52/204.591
3,424,642 A * 1/1969 Orcutt ..... B32B 17/10036 156/106
3,616,122 A * 10/1971 Orcutt ..... B32B 17/10036 156/106
3,935,497 A * 1/1976 Cowles ..... H01J 29/073 313/405
3,978,554 A * 9/1976 Miller, Jr. ..... A47G 1/0605 52/712
4,894,972 A * 1/1990 Endoh ..... B29C 45/14377 296/146.15
5,079,054 A * 1/1992 Davies ..... B29C 70/52 428/213
5,243,785 A * 9/1993 Nieboer ..... B60J 10/75 49/351
5,339,583 A * 8/1994 Hrdlicka ..... E06B 3/302 156/293
5,475,956 A * 12/1995 Agrawal ..... B29C 35/08 296/201
5,628,155 A * 5/1997 Nolte ..... E06B 5/165 52/204.54
5,687,518 A * 11/1997 Endo ..... E06B 3/10 49/501
5,707,473 A * 1/1998 Agrawal ..... B29C 35/08 156/245
5,860,257 A * 1/1999 Gerhaher ..... E04F 13/0826 52/235
6,055,977 A * 5/2000 Linard ..... F24B 13/002 126/200

(Continued)

*Primary Examiner* — Brent W Herring

(57) ABSTRACT

Various aspects of the present disclosure are directed toward apparatuses, systems, and methods of maintaining a configuration of a cladding arrangement of a fenestration apparatus.

20 Claims, 6 Drawing Sheets

(56) References Cited

U.S. PATENT DOCUMENTS

| | | | | |
|---|---|---|---|---|
| 6,283,540 | B1 * | 9/2001 | Siebelink, Jr. | B60J 7/04 296/191 |
| 6,393,780 | B1 * | 5/2002 | Jung | E06B 3/302 52/204.53 |
| 8,863,440 | B1 * | 10/2014 | Champlin | F41H 5/26 52/1 |
| 9,725,946 | B1 * | 8/2017 | Vassilev | E06B 3/302 |
| 2005/0246980 | A1 * | 11/2005 | Montero | E06B 3/5821 52/204.53 |
| 2010/0083597 | A1 * | 4/2010 | Addison | E06B 3/303 52/204.53 |
| 2012/0297707 | A1 * | 11/2012 | Lenz | E06B 3/6621 52/204.593 |

* cited by examiner

RESERVE CLADDING BIASING

CROSS-REFERENCE TO RELATED APPLICATION

This application claims priority to Provisional Application No. 62/435,215, filed Dec. 16, 2016, which is herein incorporated by reference in its entirety.

BACKGROUND

Various architectural elements, such as windows and doors, may include cladding attached to a frame of the architectural element. The cladding may be an external finish to the architectural element and may be exposed to environmental conditions. In certain instances, the frame of the architectural element and the cladding may be formed of different materials that may differently react to the environmental conditions. For example, one of the frame of the architectural element and the cladding may change shape or arrangement (e.g., expand or contract) in response to a hot or cold environment (compared to room temperature) or the frame of the architectural element and the cladding may change shape or arrangement at different rates. The change in shape or arrangement may affect the functionality of the frame of the architectural element and the cladding.

SUMMARY

Various aspects of the present disclosure are directed toward apparatuses, systems, and methods of maintaining a configuration of a cladding arrangement of a fenestration apparatus. Aspects of the present disclosure are directed toward a fenestration apparatus that includes a frame configured to house a glass pane and having a first coefficient of thermal expansion. The fenestration apparatuses may also include two or more sections of cladding arranged on the frame and perpendicular to one another. The two or more sections of cladding may have a second coefficient of thermal expansion with the second coefficient of thermal expansion being different than the first coefficient of thermal expansion. In addition, the fenestration apparatuses may include one or more springs arranged between the frame and the two or more sections of cladding and configured to mitigate against movement of the two or more sections of cladding relative to the frame in response to a force between the two or more sections of cladding.

Various aspects of the present disclosure are directed toward fenestration apparatuses that may include a frame configured to house a glass pane and a cladding arrangement arranged on the frame having a plurality of components. The plurality of components may include a first vertical component, a second vertical component, and horizontal components therebetween. In addition, the frame and the cladding arrangement may have different coefficients of thermal expansion. The fenestration apparatuses may also include a first spring arranged between the frame and the cladding arrangement and a second spring arranged between the frame and the cladding arrangement. The first spring and the second spring may be configured to maintain a configuration of the cladding arrangement in response to a force between the plurality of components of the cladding arrangement.

Various aspects of the present disclosure are also directed toward methods of maintaining a configuration of a cladding arrangement of a fenestration apparatus. The methods may include arranging the cladding arrangement on a frame. The frame may be configured to house a glass pane and having a first coefficient of thermal expansion and the cladding arrangement having a second coefficient of thermal expansion with the second coefficient of thermal expansion being different than the first coefficient of thermal expansion. In addition, the methods may include absorbing forces on the cladding arrangement with one or more springs arranged between the frame and the cladding arrangement to maintain the configuration of the cladding arrangement.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
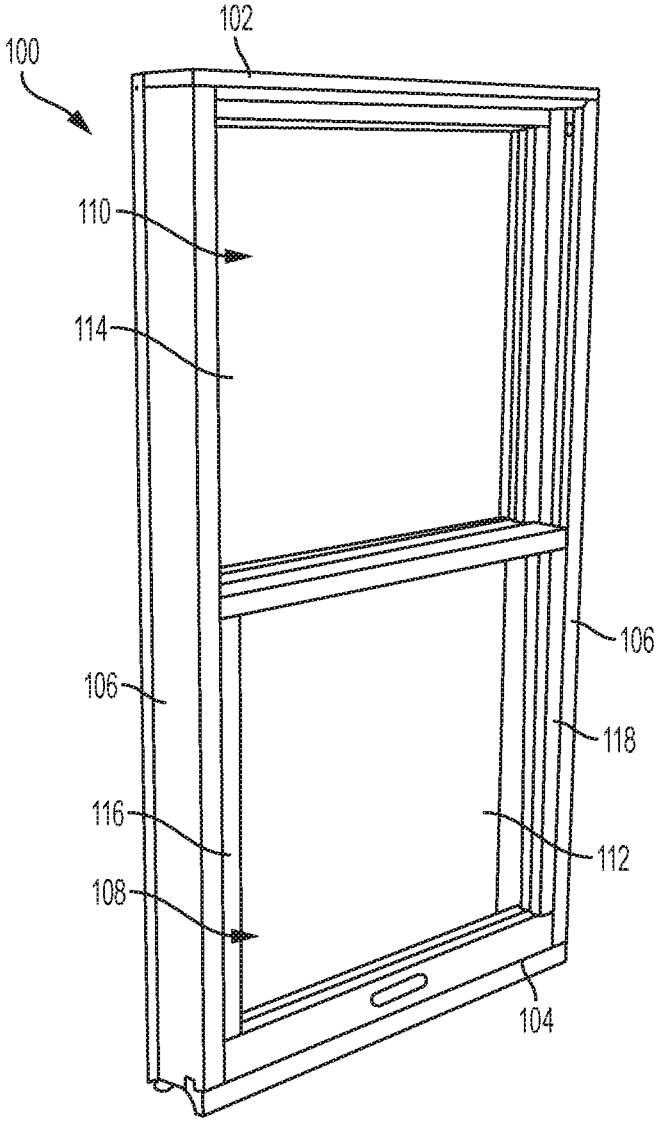
FIG. 1 is an example double hung window in accordance various aspects of the present disclosure.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Various aspects of the present disclosure are directed toward a fenestration assembly having a cladding arrangement. The fenestration assembly may include a glass pane and a frame, with the cladding arrangement arranged on the frame. The cladding arrangement and the frame may react differently to forces that occur on within the fenestration assembly. These forces may be the result of shifting or movement of the building in which the fenestration assembly is installed, temperatures changes, or other forces between the cladding arrangement and the frame. Temperature changes may cause the cladding arrangement and the frame to change shape or configuration (e.g., expand or contract) at different rates. Thus, aspects of the present disclosure may include one or more springs arranged with the fenestration assembly to maintain a configuration of the components of the fenestration assembly in response to forces that may be applied thereto.

FIG. 1 is an example hung window 100 in accordance various aspects of the present disclosure. The hung window 100 may include a head 102, a sill 104, and jambs 106 extending therebetween. The hung window 100 may be a single hung window or a double hung window, which includes sashes 108, 110. One or both of the sashes 108, 110 may be moveable. The sashes 108, 110 may include a frame configured to house one or more glass panes 112, 114 therein. Each of the sashes 108, 110 may include cladding arrangements 116, 118 arranged thereon. In addition, cladding may also be arranged on the head 102, the sill 104, and the jambs 106.

Figure 2:
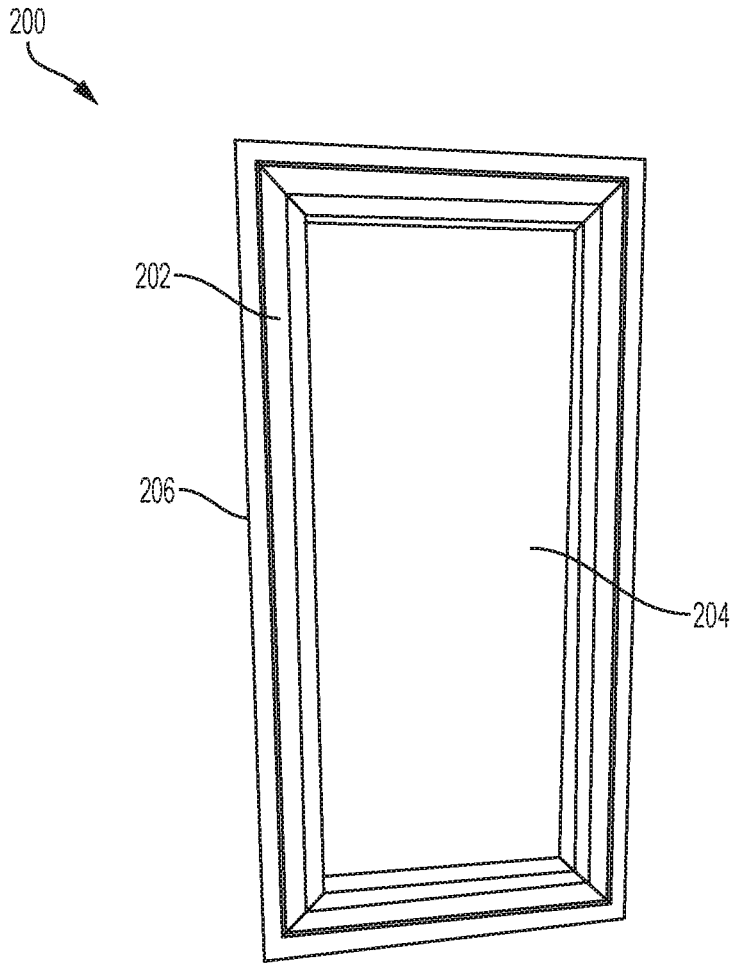
FIG. 2 is an example casement window in accordance various aspects of the present disclosure.

FIG. 2 is an example casement window 200 in accordance various aspects of the present disclosure. The casement window 200 may include a frame 202 that is configured to house one or more glass panes 204 therein. The casement window 200 may include a cladding arrangement 206 arranged on the frame 202.

Figure 3:
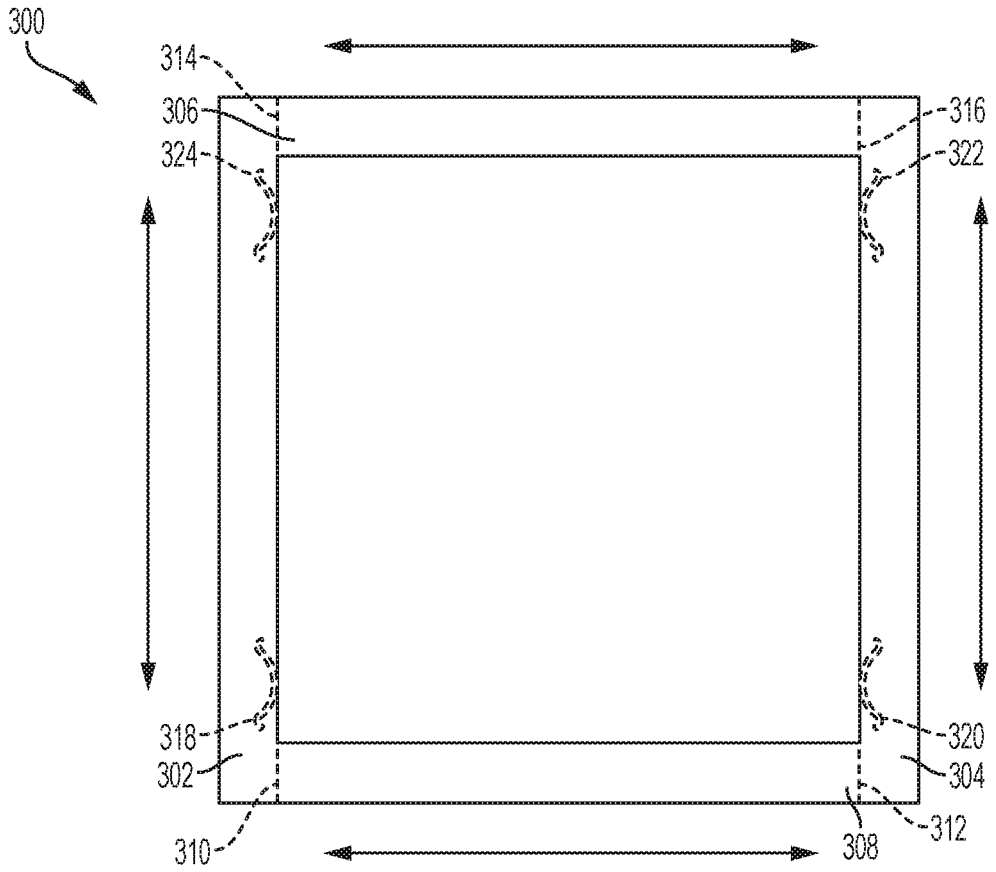
FIG. 3 is an example cladding arrangement in accordance various aspects of the present disclosure.

FIG. 3 is an example cladding arrangement 300 in accordance various aspects of the present disclosure. The cladding arrangement 300 may be coupled or affixed to a frame of a fenestration apparatus (e.g., as shown in FIGS. 1-2). The cladding arrangement 300 may have a configuration or shape. In certain instances, the cladding arrangement 300 may include vertical rails 302, 304 and horizontal rails 306, 308 such that the configuration or shape of the cladding arrangement is a four-sided structure. The cladding arrangement 300 may be square or rectangular in certain instances. In other instances, the cladding arrangement 300 may have a shape of the frame of the fenestration apparatus (e.g., circle, oval, triangular). In certain instances, the cladding arrangement 300 may also include mullions (not shown) arranged within the vertical rails 302, 304 and the horizontal rails 306, 308.

In certain instances, the vertical rails 302, 304 may have a greater length than the horizontal rails 306, 308 such that the horizontal rails 306, 308 are arranged within the bounds of the vertical rails 302, 304 as is shown in FIG. 3. In other instances, horizontal rails 306, 308 may have a greater length than the vertical rails 302, 304 such that the vertical rails 302, 304 are arranged within the bounds of the horizontal rails 306, 308. In addition, the vertical rails 302, 304 may be uncoupled or unattached from the horizontal rails 306, 308 such that the cladding arrangement 300 includes gaps 310, 312, 314, 316 between the vertical rails 302, 304 and the horizontal rails 306, 308. The gaps 310, 312, 314, 316 may be small or negligible compared to the lengths of the vertical rails 302, 304 and the horizontal rails 306, 308. For example, the gaps 310, 312, 314, 316 may be between approximately 0.01 inches and approximately 0.1 inches.

In certain instances, one or more springs 318, 320, 322, 324 may be arranged with the cladding arrangement 300. In certain instances, the one or more springs 318, 320, 322, 324 may be an elastomeric material that is resistant to forces similar to the springs shown herein. Similar to the cladding arrangement 300, the springs 318, 320, 322, 324 may also be coupled or affixed to the frame of the fenestration apparatus (e.g., as shown in FIGS. 1-2). In certain instances, the springs 318, 320, 322, 324 may include one, two, three, four, or up to eight springs. As shown in FIG. 3, the springs 318, 320, 322, 324 includes four springs 318, 320, 322, 324. In certain instances, the springs 318, 320, 322, 324 may be arranged such that one of the springs 318, 320, 322, 324 is arranged at a position relative to a section of the cladding arrangement 300 with another of the springs 318, 320, 322, 324 arranged at a corresponding position relative to an opposite section of the cladding arrangement 300. For example, as shown in FIG. 3, spring 318 and spring 320 are arranged at substantially the same position on opposite sections of the cladding arrangement 300. In addition, spring 318 and spring 324 are arranged with vertical rail 306 and spring 320 and spring 322 are arranged with vertical rail 304. A similar arrangement may occur if the springs 318, 320, 322, 324 or additional springs are arranged with the horizontal rails 306, 308.

Figure 4:
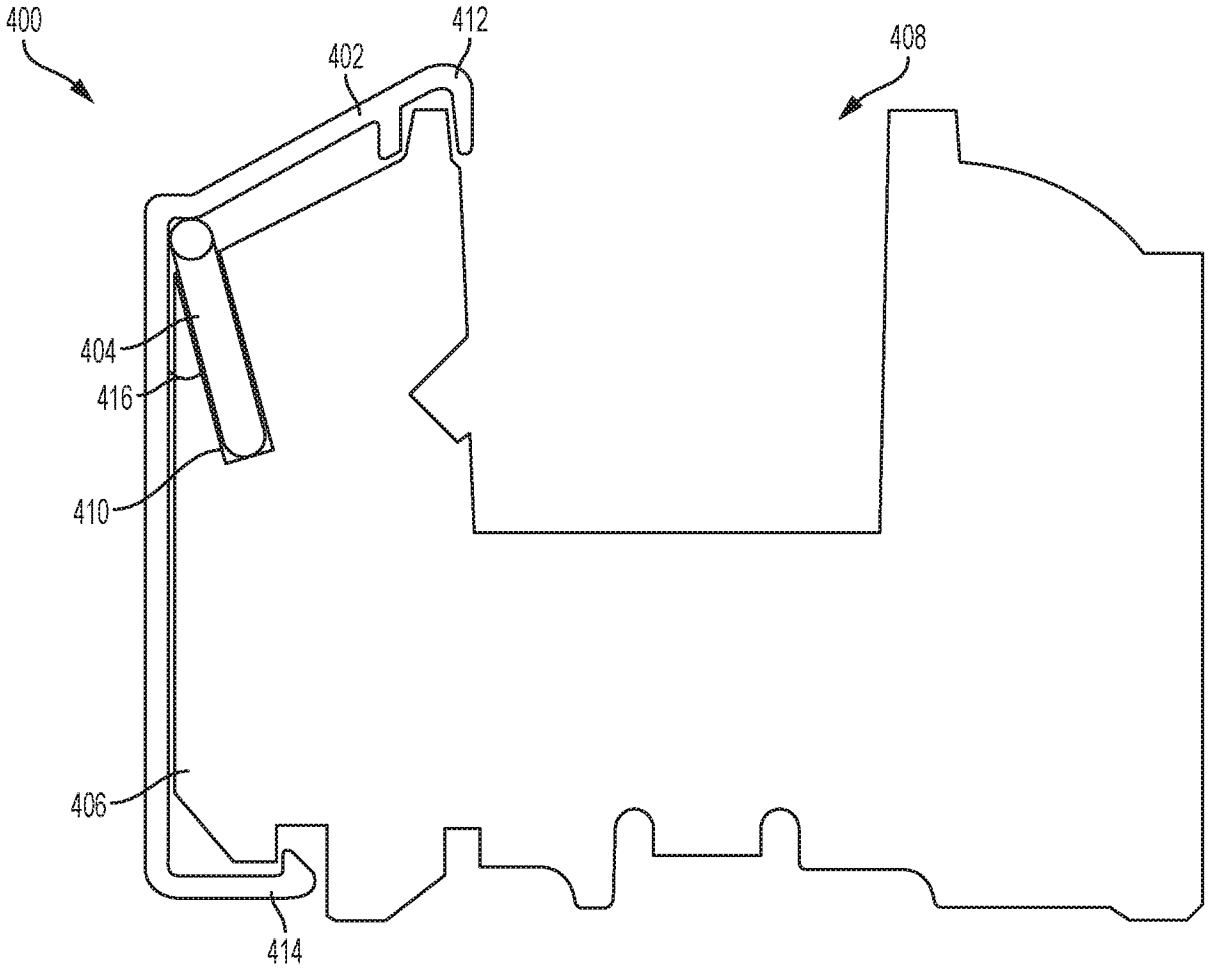
FIG. 4 is an example cross section of fenestration assembly in accordance various aspects of the present disclosure.
Figure 5:
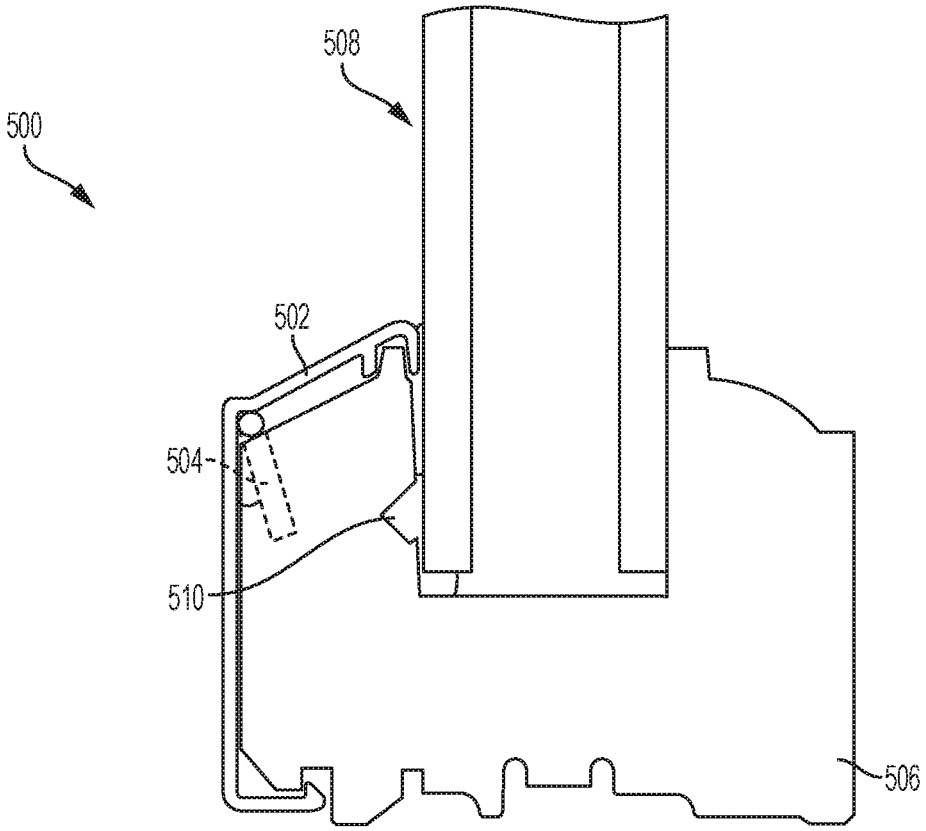
FIG. 5 is another example cross section of fenestration assembly in accordance various aspects of the present disclosure.
Figure 6:
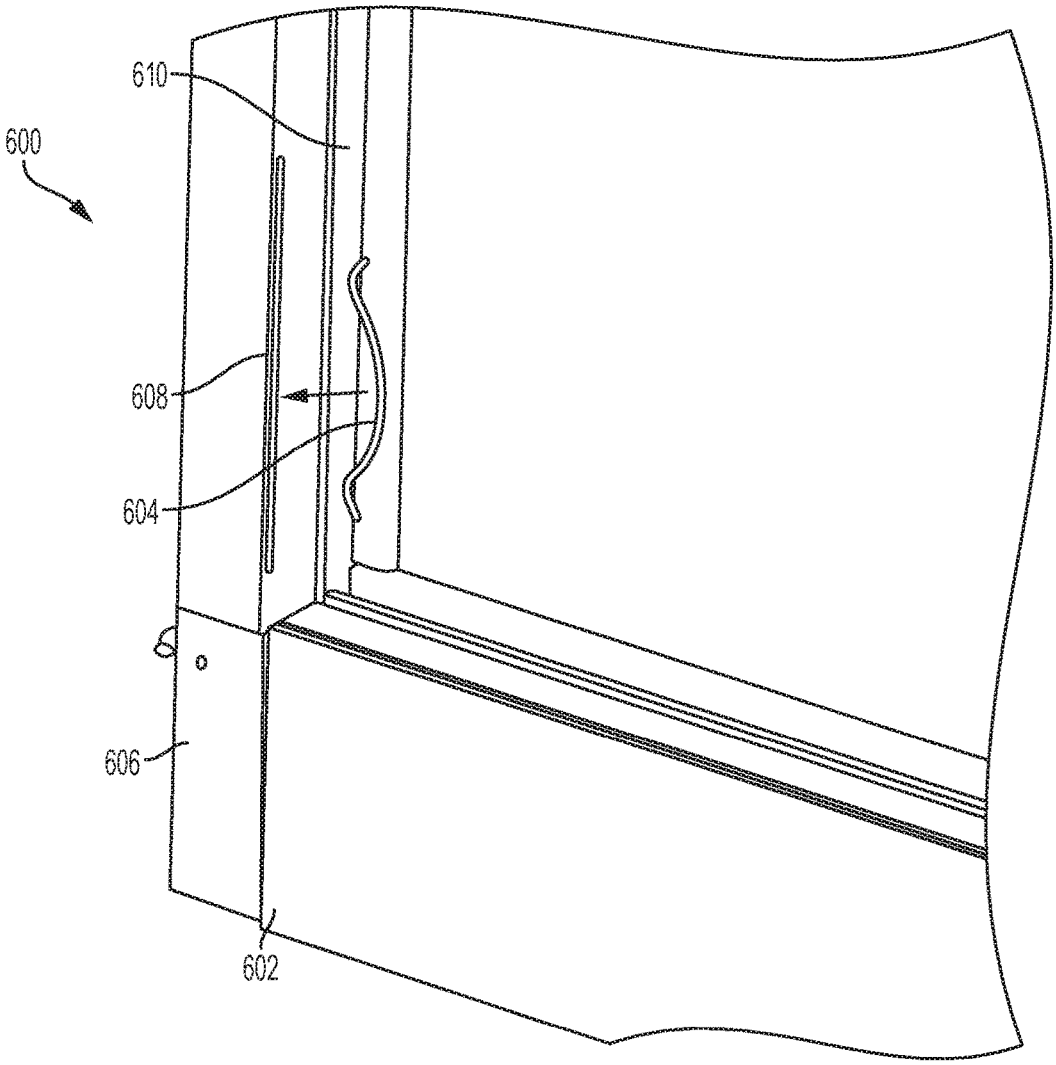
FIG. 6 is another example cross section of fenestration assembly in accordance various aspects of the present disclosure.

The springs 318, 320, 322, 324 may be arranged between the frame of the fenestration assembly (not shown) and the cladding arrangement 300, as shown in further detail in FIGS. 4-6. As shown in FIG. 3, the springs 318, 320, 322, 324 are arranged with the vertical rails 302, 304. In other instances, the springs 318, 320, 322, 324 may be similarly arranged with the horizontal rails 306, 308. Further, the horizontal rails 306, 308 may include additional springs in addition the springs 318, 320, 322, 324 are arranged with the vertical rails 302, 304. The springs 318, 320, 322, 324 may be configured to mitigate against movement of the vertical rails 302, 304 and the horizontal rails 306, 308 and the in response to a force between one or more of the vertical rails 302, 304 and the horizontal rails 306, 308. In certain instances, the forces may occur from a physical push or pull (in the direction of the arrows shown in FIG. 3) to the cladding arrangement 300. In other instances, the forces may be due to environmental conditions on the cladding arrangement 300. The environmental conditions, for example, may be the result of a temperature change that alters the properties of the frame of the fenestration assembly (not shown) and the cladding arrangement 300.

In certain instances, the frame of the fenestration assembly may have a first coefficient of thermal expansion and the cladding arrangement 300 may have a second coefficient of thermal expansion being different than the first coefficient of thermal expansion. Thus, the frame of the fenestration assembly (not shown) and the cladding arrangement 300 may react (e.g., expand, contract, shift, move) differently to temperature changes and shift (in the direction of the arrows shown in FIG. 3) relative to frame. In certain instances, the differences in the coefficients of thermal expansions may be due to the frame of the fenestration assembly being formed of a different material than the cladding arrangement 300.

For example, the cladding arrangement 300 may be formed from aluminum and the frame of the fenestration assembly (not shown) may be formed from wood (or fiberglass). The aluminum cladding arrangement 300 may be exposed to the exterior portion of a building and therefore the exterior temperature, with the wood (or fiberglass) frame may be exposed to temperature of the interior of the building (e.g., room temperature). Aluminum is a better thermal conductor than wood (or fiberglass). Thus, the aluminum cladding arrangement 300 may carry a negligible amount of the temperature gradient with the majority of the temperature gradient being carried on the wood (or fiberglass) frame. As a result, the aluminum cladding arrangement 300 may expand/contract with the wood (or fiberglass) frame being configured to expand/contract be at a proportion of the coefficient of thermal expansion of the wood (or fiberglass) frame. In certain instances, the wood (or fiberglass) frame may be considered to include a zero or negligible coefficient of thermal expansion. In certain instances, the frame of the fenestration assembly may be formed of wood, vinyl, or fiberglass, and the cladding arrangement 300 may be formed of aluminum or another metal.

The springs 318, 320, 322, 324 may mitigate against the movement of the cladding arrangement 300 and maintain the configuration or shape thereof. In addition, the springs 318, 320, 322, 324 may absorb and dampen the forces that result from the temperature changes (or other forces) such that the configuration or shape of the cladding arrangement 300 may be maintained. In certain instances, the springs 318, 320, 322, 324 may maintain the gaps 310, 312, 314, 316 between the components (the vertical rails 302, 304 and the horizontal rails 306, 308) of the cladding arrangement 300. As noted above, the gaps 310, 312, 314, 316 may be between approximately 0.01 inches and approximately 0.1 inches. For example, the gaps 310, 312, 314, 316 may be maintained between 0.000 inches to 0.030 inches are more particularly about 0.010 inches. The maintained size of the gaps 310, 312, 314, 316 may not be dependent on the size of the cladding arrangement 300 or fenestration.

The springs 318, 320, 322, 324 may damper the forces between the components (the vertical rails 302, 304 and the horizontal rails 306, 308) of the cladding arrangement 300 such that the gaps 310, 312, 314, 316 do not substantially expand. Substantially expanding the gaps 310, 312, 314, 316 would be a between approximately 0.03 inches and approximately 0.06 inches expansion. In certain instances, the temperature change resulting in forces may be up to a 100° F. swing from manufactured temperature (e.g., room temperature) of the cladding arrangement 300. Substantially expanding the gaps 310, 312, 314, 316 would be a between approximately 0.065% of the length of horizontal rails 306, 308. The springs 318, 320, 322, 324 may act independently of one another to dampen the forces that may occur. For example, forces occurring nearest one of the springs 318, 320, 322, 324 will cause the nearest spring to absorb more force than the others of the springs 318, 320, 322, 324.

The springs 318, 320, 322, 324 being configured to mitigate expansion of the gaps 310, 312, 314, 316 assists in the maintaining the configuration or shape of the cladding arrangement 300 thereby maintaining the aesthetics of the cladding arrangement 300. A person viewing the fenestration assembly may see no discernable change in the look and shape of the fenestration assembly and cladding arrangement 300. In addition, the springs 318, 320, 322, 324 being configured to mitigate expansion of the gaps 310, 312, 314, 316 assists in the maintaining the functionality of the cladding arrangement 300.

FIG. 4 is an example cross section of fenestration assembly 400 in accordance various aspects of the present disclosure. The fenestration assembly 400 may include a frame 406 configured to house a glass pane (not shown). The fenestration assembly 400 may also include a cladding component 402 arranged on the frame 406. As shown in FIG. 4, the cladding component 402 may be arranged to hold or clasp onto the frame 406. The frame 406 may have a first coefficient of thermal expansion and the cladding component 402 may have a second coefficient of thermal expansion being different than the first coefficient of thermal expansion. In addition, the fenestration assembly 400 may include one or more additional sections of the cladding component 402 such the additional section of the cladding component 402 is perpendicular to the cladding component 402 (e.g., as shown in FIG. 3). The cladding component 402 may be one of a plurality of components in a cladding arrangement (e.g., a first vertical cladding component 402, a second vertical cladding component 402, a first horizontal cladding component 402, and a second cladding component 402 as shown in FIG. 3). The frame 406 includes a channel 408 for a glass pane or panes.

The fenestration assembly 400 may also include a spring 404 arranged between the frame 406 and the cladding component 402. The spring 404 may be configured to mitigate movement of the cladding component 402 and the additional cladding component(s) (not shown) relative to the frame 406 in response to a force acting on the cladding component 402 and the additional cladding component(s). In certain instances, the spring 404 may absorb and dampen forces that act to move the cladding component 402 relative to the frame 406 such that a configuration of the cladding component 402 (and additional cladding component(s)) is maintained. For example, the cladding component 402 and additional cladding component(s)may include one or more gaps therebetween depending on the number of additional cladding component(s) (as shown in FIG. 3). The spring 404 may be configured to mitigate expansion of the gap(s) to maintain the configuration of shape of the cladding component 402 and additional cladding component(s). In certain instances, the cladding component 402 may be arranged on the frame 406 such that the cladding component 402 absorbs and dampens forces that act to move the cladding component 402 relative to the frame 406 such that a configuration of the cladding component 402 (and additional cladding component(s)) is maintained. The cladding component 402 may include a spring-like or dampening structure that allows the cladding component 402 to absorb and dampen the forces.

In certain instances, the forces may occur from a physical push or pull) to the cladding component 402. In other instances, the forces may be due to environmental conditions on the cladding component 402 (or additional cladding component(s)). The environmental conditions, for example, may be the result of a temperature change that alters the properties of the frame 406 and the cladding component 402. The frame 406 and the cladding component 402 having different coefficients of thermal expansions cause the frame 406 and/or the cladding component 402 to react (e.g., expand, contract, shift, move) differently to temperature changes and shift the cladding component 402 (or additional cladding component(s)) relative to frame 406. The spring 404 may maintain dampen the forces that result from the temperature changes (or other forces) such that the configuration or shape of the cladding component 402 (and additional cladding component(s)) may be maintained. In addition, the spring 404 mitigates against the frame 406 bowing or otherwise changing shape. The spring 404 dampens the forces that may occur and allows for the cladding component 402 to shift relative to the frame 406 while maintaining a configuration of the cladding component 402 (and other additional cladding component(s) arranged therewith). The spring 404 may be configured to absorb up to between 15 to 30 pounds of force in response to a temperature change.

In certain instances, the spring 404 may be arranged within a portion of the frame 406. The frame 406, for example, may include a slot 410 that is cut-away from the frame 406 into which the spring 404 may be arranged. In addition, the spring 404 may be arranged within the slot 410 such that the spring is angled outwardly relative to the frame 406. The spring 404 may be configured to press the cladding component 402 outwardly from the frame 406. Portions 412, 414 of the cladding component 402 may be configured to grasp or grip the frame 406 to hold the cladding component 402 tight on and against the frame 406. The spring 404 may be arranged at an angle 416 between 10 degrees and 30 degrees outwardly relative to the frame 406. As shown in FIG. 4, the spring 404 is arranged at a 15 degree angle relative to the frame 406.

The spring 404 being configured to mitigate expansion of the gaps between the cladding component 402 and additional cladding component(s) assists in the maintaining the configuration or shape of the cladding component 402 and additional cladding component(s) thereby maintaining the aesthetics of the cladding component 402 and additional cladding component(s) (e.g., a cladding arrangement). A person viewing the fenestration assembly may see no discernable change in the look and shape of the fenestration assembly and the cladding arrangement. In addition, the spring 404 being configured to maintain the configuration or shape of the cladding component 402 and additional cladding component(s) assists in the maintaining the functionality of the cladding arrangement. For example, the cladding component 402 and additional cladding component(s) may be used for aesthetic purposes and/or to provide a protective material layer against the infiltration of weather elements. The spring 404 mitigating against expansion of gaps within the cladding arrangement (gaps between the cladding component 402 and the additional cladding component(s) as shown in FIG. 3) mitigate against infiltration of weather elements that would occur if the gaps would expand. In addition, the spring 404 also reduces stress on frame 406 by absorbing and dampening forces that occur within the fenestration assembly 400.

The illustrative components shown in FIG. 4 are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIG. 4 may be, in embodiments, integrated with various other components depicted therein (and/or components not illustrated), all of which are considered to be within the ambit of the disclosed subject matter. For example, the spring 404 may be one of multiple springs as is shown in FIG. 3. In these instances, the additional springs function in substantially the same manner as described with reference to the spring 404. In addition, the cladding component 402 may be one of multiple cladding components as shown in FIG. 3.

FIG. 5 is another example cross section of fenestration assembly 500 in accordance various aspects of the present disclosure. The fenestration assembly 500 may include a cladding component 502, a spring 504, and a frame 506. As shown in FIG. 5, the cladding component 502 may be arranged on the frame 506 with the spring 504 arranged therebetween. The frame 506 may have a first coefficient of thermal expansion and the cladding component 502 may have a second coefficient of thermal expansion being different than the first coefficient of thermal expansion. In addition, the cladding component 502 may be one of a plurality of components in a cladding arrangement (e.g., a first vertical cladding component 502, a second vertical cladding component 502, a first horizontal cladding component 502, and a second cladding component 502 as shown in FIG. 3). The frame 506 may be configured to house a glass pane or panes. As shown in FIG. 5, the frame 506 is configured to house a double pane 508 of glass. The pane 508 of glass of may be held in place within the frame 506 by a sealant 510.

The spring 504 may be configured to mitigate movement of the cladding component 502 and the additional cladding component(s) (not shown) relative to the frame 506 in response to a force acting on the cladding component 502 and the additional cladding component(s). In certain instances, the spring 504 may absorb and dampen forces that act to move the cladding component 502 (or the additional cladding component(s)) relative to the frame 506 such that a configuration of the cladding component 502 (and additional cladding component(s)) is maintained. For example, the cladding component 502 and additional cladding component(s) may include one or more gaps therebetween depending on the number of additional cladding components (as shown in FIG. 3). The spring 504 may be configured to mitigate expansion of the gap(s) to maintain the configuration of shape of the cladding component 502 and additional cladding component(s). Movement of the cladding component 502 and additional cladding component(s) occurs within the plane of the pane 508 of glass.

In certain instances, the forces may be due to environmental conditions (such as temperature changes). Temperature changes may cause the frame 506 and/or the cladding component 502 to react (e.g., expand, contract, shift, move) differently to temperature changes and shift the cladding component 502 (or additional cladding component(s)) relative to frame 506. The spring 504 may maintain dampen the forces that result from the temperature changes (or other forces) such that the configuration or shape of the cladding component 502 (and additional cladding component(s)) may be maintained. In addition, the spring 504 mitigates against the frame 506 bowing or otherwise changing shape. The spring 504 dampens the forces that may occur and allows for the cladding component 502 to shift relative to the frame 506 while maintaining a configuration of the cladding component 502 (and other additional cladding component(s) arranged therewith).

The illustrative components shown in FIG. 5 are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIG. 5 may be, in embodiments, integrated with various other components depicted therein (and/or components not illustrated), all of which are considered to be within the ambit of the disclosed subject matter. For example, the spring 504 may be one of multiple springs as is shown in FIG. 3. In these instances, the additional springs function in substantially the same manner as described with reference to the spring 504. In addition, the cladding component 502 may be one of multiple cladding components as shown in FIG. 3.

FIG. 6 is another example cross section of fenestration assembly 600 in accordance various aspects of the present disclosure. The fenestration assembly 600 may include a cladding component 602, a spring 604, and a frame 606. As shown in FIG. 6, the cladding component 602 may be arranged on the frame 606. The spring 604 is shown apart from the frame 606, however, the spring 604 may be arranged within a slot 608 in the frame 606. In addition, the cladding component 602 may be one of a plurality of components in a cladding arrangement (e.g., a first vertical cladding component 602, a second vertical cladding component 602, a first horizontal cladding component 602, and a second cladding component 602 as shown in FIG. 3). Thus, one of the first vertical cladding component 602 and the second vertical cladding component 602 may be arranged on the frame 606. The frame 606 may be configured to house a glass pane 610.

As shown in FIG. 6, the spring 604 is a leaf spring. In other instances, the spring 604 may be a flat leaf spring, a linear leaf spring, a coil spring, or a wire spring. The spring 604 may be configured to mitigate movement of the cladding component 602 and the additional cladding components (not shown) relative to the frame 606 in response to a force acting on the cladding component 602 and the additional cladding components. In certain instances, the spring 604, when arranged in the slot 608, may absorb and dampen forces that act to move the cladding component 602 and the additional cladding component(s)) relative to the frame 606 such that a configuration of the cladding component 602 and additional cladding components is maintained. For example, the cladding component 602 and additional cladding components) may include gaps therebetween depending on the number of additional cladding components (as shown in FIG. 3). The spring 604 may be configured to mitigate expansion of the gaps to maintain the configuration of shape of the cladding component 602 and the additional cladding components. Movement of the cladding component 602 and additional cladding components occurs within the plane of the slot 608 of glass.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A fenestration apparatus comprising:

a frame configured to house a glass pane and having a first coefficient of thermal expansion;

two or more sections of cladding arranged on the frame and perpendicular to one another, the two or more sections of cladding having a second coefficient of thermal expansion with the second coefficient of thermal expansion being different than the first coefficient of thermal expansion; and one or more springs arranged between the frame and the two or more sections of cladding within at least one slot in the frame and configured to mitigate against movement of the two or more sections of cladding relative to the frame in response to a force between the two or more sections of cladding.

2. The apparatus of claim 1, further comprising a gap between the two or more sections of cladding, and the one or more springs are configured to maintain the gap between the between the two or more sections of cladding.

3. The apparatus of claim 2, wherein the one or more springs are configured to mitigate against expansion of the gap in response to a temperature change resulting in the force between the two or more sections of cladding.

4. The apparatus of claim 3, wherein the one or more springs are configured to mitigate against bowing of the frame in response to the force between the two or more sections of cladding.

5. The apparatus of claim 4, wherein the one or more springs are configured to absorb up to between 15 to 30 pounds of force in response to the temperature change.

6. The apparatus of claim 1, wherein the one or more springs are arranged within a portion the frame.

7. The apparatus of claim 6, wherein the one or more springs are angled outwardly relative to the portion of the frame.

8. The apparatus of claim 1, wherein the one or more springs are configured to maintain a configuration of the two or more sections of cladding relative to the frame in response to the force.

9. The apparatus of claim 1, wherein the one or more springs are configured to mitigate against movement of the two or more sections of cladding in response to a temperature change resulting in the force between the two or more sections of cladding.

10. The apparatus of claim 1, wherein the one or more springs includes a spring, and the spring and one of the two or more sections of cladding are configured to mitigate against movement of the two or more sections of cladding relative to the frame in response to the force between the two or more sections of cladding.

11. The apparatus of claim 10, wherein the one of the two or more sections of cladding is configured to absorb the force to mitigate against movement of the two or more sections of cladding.

12. A fenestration apparatus comprising:

a frame configured to house a glass pane and having a first coefficient of thermal expansion;

a cladding arrangement arranged on the frame having a plurality of components including a first vertical component, a second vertical component, and horizontal components therebetween, the cladding arrangement having a second coefficient of thermal expansion with the second coefficient of thermal expansion being different than the first coefficient of thermal expansion; and a first spring arranged between the frame and the cladding arrangement within an angled slot in the frame and a second spring arranged between the frame and the cladding arrangement within an angled slot in the frame, the first spring and the second spring being configured to maintain a configuration of the cladding arrangement in response to a force between the plurality of components of the cladding arrangement.

13. The apparatus of claim 12, wherein the first spring and the second spring are configured to mitigate against movement of the cladding arrangement in response to a temperature change resulting in the force between the plurality of components of the cladding arrangement.

14. The apparatus of claim 13, wherein at least one of the frame and the cladding arrangement expands or contracts in response to the temperature change resulting in the force between the plurality of components of the cladding arrangement.

15. The apparatus of claim 13, wherein the first spring and the second spring are configured to mitigate against bowing of the frame in response to the force between components of the cladding arrangement.

16. The apparatus of claim 13, wherein the first spring and the second spring are at least one of a wire leaf spring, a flat leaf spring, a linear leaf spring, a coil spring, and a wire spring.

17. The apparatus of claim 12, further comprising a first gap between the first vertical component and a first horizontal component of the horizontal components, a second gap between the second vertical component and the first horizontal component, and a third gap between the first vertical component and a second horizontal component of the horizontal components, a fourth gap between the second vertical component and the second horizontal component, and wherein the first spring and the second spring are configured to maintain at least one of the first gap, the second gap, the third gap, and the fourth gap in response to the force between the plurality of components of the cladding arrangement.

18. The apparatus of claim 12, further comprising a third spring arranged between the frame and the first vertical component of the cladding arrangement and a fourth spring arranged between the frame and the second vertical component of the cladding arrangement, and wherein the first spring is arranged between the frame and the first vertical component of the cladding arrangement and the second spring is arranged between the frame and the second vertical component of the cladding arrangement.

19. A method of maintaining a configuration of a cladding arrangement of a fenestration apparatus, the method comprising:

arranging the cladding arrangement on a frame, the frame being configured to house a glass pane and having a first coefficient of thermal expansion and the cladding arrangement having a second coefficient of thermal expansion with the second coefficient of thermal expansion being different than the first coefficient of thermal expansion; and absorbing forces on the cladding arrangement with one or more springs arranged between the frame and the cladding arrangement within a slot in the frame to maintain the configuration of the cladding arrangement.

20. The method of claim 19, wherein absorbing forces includes mitigating against expansion of gaps between components of the cladding arrangement.

* * * * *